United States Patent [19]

Tomita et al.

[11] 4,118,710

[45] Oct. 3, 1978

[54] ELECTROSTATIC PRINTING APPARATUS COMPRISING IMPROVED PRINTING ELECTRODE HEAD

[75] Inventors: Satoru Tomita; Tamio Ohori; Shuichi Karasawa; Wasaburo Ohta, all of Tokyo, Japan

[73] Assignee: Ricoh Company, Ltd., Tokyo, Japan

[21] Appl. No.: 752,361

[22] Filed: Dec. 20, 1976

[30] Foreign Application Priority Data

Dec. 23, 1975 [JP] Japan ..... 50-154323
Dec. 23, 1975 [JP] Japan ..... 50-154325

[51] Int. Cl.[2] ..... G03G 15/08
[52] U.S. Cl. ..... 346/153; 118/647; 346/155; 355/3 DD
[58] Field of Search ..... 346/153, 155; 355/3 TR, 355/3 DD, 12; 118/647, 648, 638, 639

[56] References Cited

U.S. PATENT DOCUMENTS

| | | | |
|---|---|---|---|
| 2,918,580 | 12/1959 | Howell | 346/155 |
| 3,428,025 | 2/1969 | Sullivan | 118/647 |
| 3,611,419 | 10/1971 | Blumenthal | 346/155 |
| 3,618,118 | 11/1971 | Lloyd | 346/155 |
| 3,638,610 | 2/1972 | Lyles | 118/647 |
| 3,981,268 | 9/1976 | Tsukamoto | 355/3 DD |

*Primary Examiner*—Jay P. Lucas
*Attorney, Agent, or Firm*—Frank J. Jordan

[57] ABSTRACT

Liquid or dry developing substance comprising charged particles is applied to a base electrode in the form of a rotary cylinder. A sheet of recording paper is fed in contact with the cylinder. A printing head comprises at least one bias electrode to which is applied a bias voltage of a polarity to repel the charged particles against the cylinder. At least one shaping electrode which extends closer to the recording sheet than the bias electrode is selectively applied with a voltage of a polarity and magnitude to overcome the bias voltage and attract only the charged particles immediately adjacent to the shaping electrode to the recording sheet for printing.

14 Claims, 9 Drawing Figures

ELECTROSTATIC PRINTING APPARATUS COMPRISING IMPROVED PRINTING ELECTRODE HEAD

BACKGROUND OF THE INVENTION

The present invention relates to an electrostatic printing apparatus comprising an improved printing electrode head.

U.S. Pat. No. 3,898,674 to Koch discloses improvements to a non-impact printer which is disclosed in U.S. Pat. No. 3,550,153 to Haeberle. In this printer, a pulsed electric field is applied between a shaping and base electrode through a donor sheet and a closely adjacent recipient sheet to transfer electrically conductive printing material particles from the doner sheet to the recipient sheet. A shield electrode is disclosed by Koch which cancels the fringe components of the pulsed electric field emanating from points on the surface of the shaping electrode outside the printing face in order to reduce the size of the printed mark and increase the resolution of the system. An important aspect of this prior art printer is that a gap must be maintained between the donor sheet and the recipient sheet.

The present invention constitutes an improvement to an electrostatic printer which eliminates the need for a donor sheet and thereby the cost of printing. In such a printer, a rotary cylinder is coated with a liquid or dry layer of a developing substance comprising charged particles of pigment or the like and a recording sheet, which may be an ordinary sheet of writing paper, is fed in contact with the cylinder. A printing head is positioned closely adjacent to the cylinder so that the recording sheet is disposed between the cylinder and printing head. The printing head comprises at least one shaping electrode which may be in the form of an alphanumeric character. Alternatively, a number of shaping electrodes may be provided in a dot matrix configuration. A voltage applied to the shaping electrode or electrodes attracts adjacent particles to the recording sheet for printing, with the particles being later thermally or otherwise fixed to the recording sheet to provide a permanent record.

A problem which has heretofore remained unsolved in this type of system is that since the developing substance is maintained in contact with the recording sheet charged particles will adhere to the recording sheet even in non-printing areas. This creates a smeary appearance and severely limits the contrast which can be provided by the printer.

SUMMARY OF THE INVENTION

The present invention overcomes the problem of particle adherence to non-printing areas of a recording sheet through the use of at least one biasing electrode associated with each shaping electrode which repels the charged particles against the surface of the cylinder. A sufficient voltage of opposite polarity is applied to the shaping electrode to overcome the effect of the bias voltage and attract charged particles to the recording sheet only in the desired printing areas immediately adjacent to the shaping electrodes. The effect is maximized consistent with the non-production of electrical discharge between the shaping electrodes and the biasing electrodes by having the shaping electrodes extend slightly closer to the recording sheet than the bias electrodes.

It is an object of the present invention to provide an electrostatic printing apparatus comprising an improved printing electrode head which eliminates the adherence of particles of printing material to non-printing areas of a recording sheet.

It is another object of the present invention to provide an electrostatic printing apparatus capable of improved printing contrast.

It is another object of the present invention to provide an electrostatic printing apparatus capable of improved resolution.

It is another object of the present invention to provide a generally improved non-impact electrostatic printing apparatus.

Other objects, together with the foregoing, are attained in the embodiments described in the following description and illustrated in the accompanying drawing.

DESCRIPTION OF THE PREFERRED EMBODIMENTS

While the electrostatic printing apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
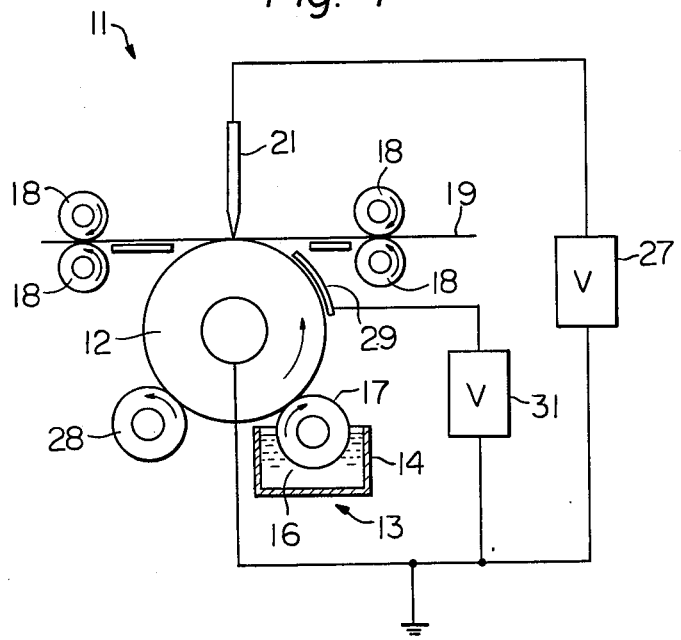
FIG. 1 is a schematic view of an electrostatic printing apparatus embodying the present inveniton.

Referring now to FIG. 1 of the drawing, an electrostatic printing apparatus embodying the present invention is generally designated by the reference numeral 11 and comprises a base electrode in the form of a rotary cylinder 12 which is driven for counterclockwise rotation at constant speed. A developing unit 13 comprises a developing tank 14 filled with a developing substance 16 which may be in liquid or dry form. Where the developing substance 16 is in liquid form, it comprises a liquid carrier in which is suspended a large number of fine charged particles of pigment or the like. Where the cylinder 12 is grounded as shown, the particles of developing substance may be given a negative charge. Where the developing substance is in dry form, it may be constituted by charged particles similar to those of the liquid developing substance with the liquid carrier omitted.

The developing unit 13 further comprises an applicator which is symbolically shown as a roller 17 driven for clockwise rotation in brushing contact with the cylinder 12. The lower portion of the roller 17 is immersed in the developing substance 16 so that it becomes coated with the developing substance 16 upon rotation. The roller 17 transfers the developing substance 16 to the cylinder 12 through contact therewith in such a manner that an even coating of the developing substance 16 is applied to the cylinder 12. Feed rollers 18 are provided to feed a recording sheet 19 in contact with the surface of the cylinder 12 from right to left as viewed in FIG. 1 so that the surface speeds of the recording sheet 19 and cylinder 12 are preferably the same. In this manner, the lower surface of the recording sheet 19 contacts the developing substance 16 on the cylinder 12. The recording sheet 19 need not be made of any special material, and even ordinary writing paper may be used.

Figure 2:
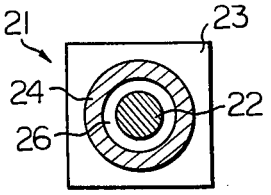
FIG. 2 is a horizontal sectional view of a printing electrode assembly of the printing apparatus.
Figure 3:
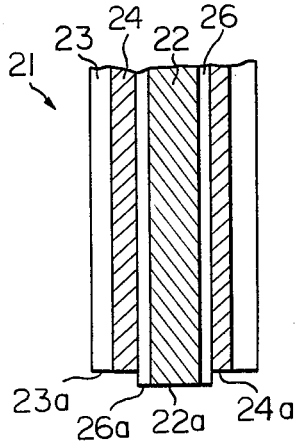
FIG. 3 is a vertical secitonal view of the printing electrode assembly shown in FIG. 2.

A printing electrode head 21 is provided closely adjacent to the cylinder 12 so that the recording sheet 19 is disposed between the printing head 12 and the cylinder 12. The printing head 21 comprises at least one shaping electrode and at least one biasing electrode. Preferably a number of shaping electrodes are provided. In one form the shaping electrodes may be configured as alphanumeric characters on a printing wheel or cylinder so that the desired shaping electrode may be moved into a printing position as the recording sheet 19 reaches the corresponding printing position. In another form the shaping electrodes may be arranged in a dot matrix configuration. The particular arrangement of shaping electrodes is not the subject matter of the present invention, and to clearly illustrate the novel aspects of the invention, only one shaping electrode 22 is shown in FIGS. 2 and 3 as being in the form of a rod which is oriented perpendicular to the surface of the cylinder 12. In other words, the longitudinal axis of the shaping electrode 22 lies perpendicular to and intersects the longitudinal axis of the cylinder 12, with a lower end **22*a* of the shaping electrode 22 being positioned adjacent to the cylinder 12. The printing head 21 further comprises a block 23 made of an insulative material which is formed with a hole (not designated) in which is press fitted a cylindrical bias electrode 24. The bias electrode 24 is formed with a bore (not designated) in which is press fitted a cylindrical insulator 26. The insulator 26 is in turn formed with a bore (not designated) in which is press fitted the shaping electrode 22. It will be seen that shaping the electrode 22, insulator 26 and bias electrode 24** are mutually coaxial.

In accordance with an important feature of the present invention, the lower end **24*a* of the bias electrode 24 is recessed relative to the lower end 22*a* of the shaping electrode 22. In other words, the shaping electrode 22 extends closer to the cylinder 12 than does the bias electrode 24. The lower end 26*a* of the insulator 26 is preferably flush with the lower end 22*a* of the shaping electrode 22. The lower end 23*a* of the block 23 is preferably flush with the lower end 24*a* of the bias electrode 24. Although the printing head 21 is shown as comprising only one electrode assembly including one shaping electrode 22 and one bias electrode 24**, in actual practice a number of electrode assemblies are provided in, for example, a 5 × 7 dot matrix configuration.

In the embodiment illustrated in FIGS. 1 to 3, a voltage source 27 applies a constant negative voltage of, for example, −150VDC to the bias electrode 24. This causes all of the charged particles in the developing substance 16 on the cylinder 12 in the vicinity of the printing head 21 to be repelled against the surface of the cylinder 12 away from the recording sheet 19. Where the developing substance 16 is in liquid form, the external strata of the developing substance 16 which contacts the recording sheet 19 is completely free of charged particles.

When the recording sheet 19 is fed by the rollers 18 to a printing position, the voltage source 27 applies a positive voltage of, for example, +600VDC to the shaping electrode 22. It will be noted that the negative voltage is still applied to the bias electrode 24. This causes the creation of a positive electric field in the form of a narrow tunnel or column to extend from the shaping electrode 22 through the recording sheet 19 into the developing substance 16 on the cylinder 12. This attracts charged particles from the surface of the cylinder 12 onto the surface of the recording sheet 19 only in the area directly below the shaping electrode 22. After a sufficient length of time for the particles to be attracted to the recording sheet 19 for printing, the recording sheet 19 is fed away from the cylinder 12 by the rollers 18 and the particles are thermally or otherwise fixed to the recording sheet 19 to provide a permanent record. After the printing process is completed, a cleaning unit symbolically illustrated as a roller 28 driven for counterclockwise brushing engagement with the cylinder 12 removes the developing substance 16 therefrom for recycling.

The operation of the apparatus 11 may be enhanced by providing an arcuate electrode 29 closely adjacent to the cylinder 12. A voltage source 31 applies a negative voltage to the electrode 29 so that the charged particles are repelled against the surface of the cylinder 12 before reaching the printing head 21.

Although the specific embodiment shown and described thus far comprises a grounded cylinder 12, negatively charged developer particles, a negatively charged bias electrode 24 and a positively charged shaping electrode 22, a number of other configurations are possible within the scope of the present invention. For example, single polarity voltage operation with negatively charged particles may be achieved by applying a positive potential to the cylinder 12 and grounding the bias electrode 24. In this case the charged particles are attracted to the cylinder 12 by the positive voltage thereon. The particles may be attracted to the recording sheet 19 by applying a positive potential to the shaping electrode 22 which is, for example, +600VDC higher than the voltage on the cylinder 12.

Corresponding operations are possible using positively charged particles. In one form the cylinder 12 may be grounded, a positive voltage applied to the bias electrode 24 and a negative voltage of higher magnitude applied to the shaping electrode 22 for printing. Single polarity operation may be achieved by applying a negative voltage to the cylinder 12, grounding the bias electrode 24 and applying a negative voltage to the shaping electrode 22 which is, for example, −600VDC relative to the voltage on the cylinder 12.

The particular configuration of the printing head 21 is an important feature of the invention. The effect of applying a voltage to the bias electrode 24 urging the charged particles against the surface of the cylinder 12 and applying a voltage to the shaping electrode 22 to overcome the effect of the bias electrode 24 and attract charged particles to the recording sheet 19 in an area substantially equal to the area of the lower end **22*a* of the shaping electrode 22 is maximized by making the insulator 26 as thin as possible thereby providing the bias electrode 24 as close as possible to the shaping electrode 22. However, at the voltages necessary for the operation of the apparatus 11, if the bias electrode 24 is made too close to the shaping electrode 22, an electrical discharge will ocuur therebetween which will seriously impair the performance of the apparatus 11. However, the present invention extends the shaping electrode 22 closer to the cylinder 12 than the bias electrode 24, with the lower end 26***a* of the insulator 26 substantially flush with the lower end 22*a* of the shaping electrode 22. This increases the air gap between the electrodes 22 and 24 from the thickness of the insulator 26 which would be the case if the lower ends 22*a* and 24*a* were flush to the thickness of the insulator 26 plus the amount of protrusion of the shaping electrode 22 past the bias electrode 24. This enables the insulator 26 to be made thinner and the bias electrode 24 spaced closer to the shaping electrode 22 without the undesirable side effect of electrical discharge between the electrodes 22 and 24. With the tunnel effect of the positive electrical field from the shaping electrode 22 enhanced, the apparatus 11 provides higher resolution and higher contrast printing than can be provided by comparable apparatus of the prior art.

Figure 4:
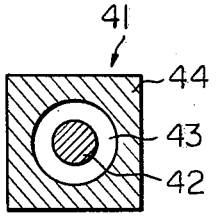
FIG. 4 is a horizontal sectional view of a modified printing electrode assembly of the printing apparatus.
Figure 5:
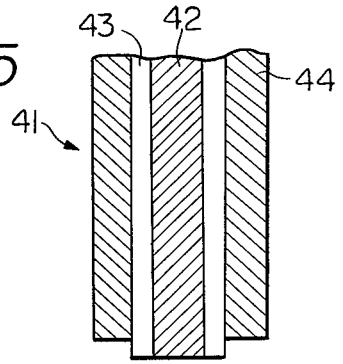
FIG. 5 is a vertical sectional view of the printing electrode assembly shown in FIG. 4.

FIGS. 4 and 5 illustrate a modified printing head 41 which comprises a shaping electrode 42 and an insulator 43 which are essentially similar to the shaping electrode 22 and insulator 26. In the printing head 41, however, the insulative block 23 is replaced by a conductive block 44 and the cylindrical bias electrode 24 is omitted, with the block 44 constituting the bias electrode. The printing head 41 features ease of construction and greater repulsion of the charged particles against the cylinder 12.

Figure 6:
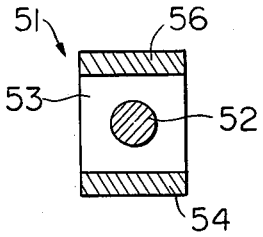
FIG. 6 is a horizontal sectional view of another modified printing electrode assembly of the printing apparatus.
Figure 7:
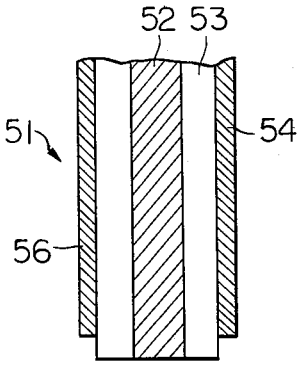
FIG. 7 is a vertical sectional view of the printing electrode assembly shown in FIG. 6.

FIGS. 6 and 7 illustrate another printing head 51 which comprises a shaping electrode 52 which is pressed into a hole (not designated) formed in an insulative block 53. The bias electrode is constituted by two plates 54 and 56 which are attached to the block 53 on opposite sides thereof and may be used as structural members in the assembly of the printing head 51. The plates 54 and 56 are normally electrically connected together for use.

Figure 8:
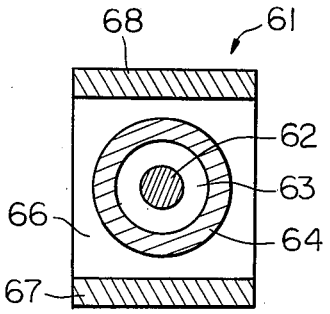
FIG. 8 is a horizontal sectional view of yet another modified printing electrode assembly.
Figure 9:
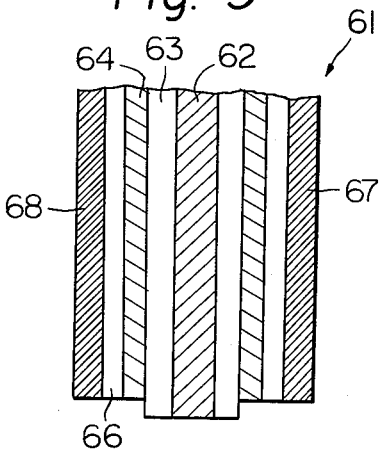
FIG. 9 is a vertical secitonal view of the printing electrode assembly shown in FIG. 8.

FIGS. 8 and 9 illustrate yet another printing head 61 which is a combination of the printing heads 21 and 51. The printing head 61 comprises a shaping electrode 62, insulator 63, bias electrode 64 and an insulative block 66 which are essentially similar to the shaping electrode 22, insulator 26, bias electrode 24 and insulative block 23. In addition, the printing head 61 comprises two bias electrode plates 67 and 68 provided on opposite sides of the shaping electrode 62.

The printing head 61 may be used in several ways. For example, the bias electrode 64 and bias electrode plates 67 and 68 may be electrically connected together. Alternatively, repelling voltages of the same or different magnitudes may be applied to the bias electrode 64 and plates 67 and 68 respectively. Whereas the voltages applied to the biasing electrode 64 and plates 67 and 68 would be sufficient to prevent printing even with the voltage applied to the shaping electrode 62, removal or reduction of the voltage on either the bias electrode 64 or plates 67 and 68 would allow the voltage on the shaping electrode 62 to overcome the bias voltage for printing.

In summary, it will be seen that the present invention overcomes the problems of low contrast, low resolution and smearing which have existed heretofore in electrostatic printing apparatus in which the recording sheet directly contacts the developing substance. Many modifications will become possible for those skilled in the art after receiving the teachings of the present disclosure without departing from the scope thereof.

What is claimed is:

1. An electrostatic printing apparatus comprising in combination:

a base electrode;

means for applying a developing substance including charged particles onto the base electrode;

means for positioning a recording sheet in contact with the base electrode;

a printing head including at least one shaping electrode and at least one bias electrode disposed closely adjacent to the base electrode with the recording sheet disposed between the base electrode and the printing head;

means for applying a first voltage between the base electrode and the bias electrode to urge the charged particles against the base electrode; and means for selectively applying a second voltage to the shaping electrode to overcome the first voltage and attract only those charged particles in an area of the base electrode adjacent to the shaping electrode to the recording sheet for printing.

2. An apparatus as in claim 1, in which the shaping electrode is in the form of a rod oriented perpendicular to the base electrode.

3. An apparatus as in claim 2, in which the bias electrode is in the form of a cylinder coaxially disposed around the shaping electrode.

4. An apparatus as in claim 3, further comprising a pair of bias electrode plates disposed on opposite sides of the bias electrode.

5. An apparatus as in claim 4, further comprising an insulator disposed between the bias electrode and the bias electrode plates.

6. An apparatus as in claim 3, further comprising a cylindrical insulator coaxially disposed between the shaping electrode and the bias electrode.

7. An apparatus as in claim 2, in which the bias electrode is in the form of a block formed with a hole, the apparatus further comprising a cylindrical insulator disposed in the hole and being formed with a bore, the shaping electrode being disposed in the bore.

8. An apparatus as in claim 2, in which the bias electrode comprises two plates disposed on opposite sides of the shaping electrode.

9. An apparatus as in claim 1, further comprising an insulator disposed between the shaping electrode and the bias electrode.

10. An apparatus as in claim 1, in which the base electrode is in the form of a rotary cylinder.

11. An apparatus as in claim 1, in which the shaping electrode extends closer to the recording sheet than the bias electrode.

12. An apparatus as in claim 1 wherein said means for applying the first voltage between the base electrode and the bias electrode comprises applying the first voltage to cause the charged particles to be repelled against the base electrode and away from the recording sheet, and said means for selectively applying a second voltage to the shaping electrode comprises applying the second voltage of a polarity opposite to the polarity of the first voltage to overcome the first voltage and thereby attract charged particles substantially only in the area underlying the shaping electrode to the recording sheet for printing, whereby printing of high resolution and high contrast is effected.

13. An apparatus according to claim 1 wherein the application of said first and second voltages causes the creation of an electric field in the form of a funnel.

14. An apparatus according to claim 1 wherein the application of said first and second voltages causes the creation of an electric field in the form of a column.

* * * * *